US007071433B2

(12) United States Patent
Holscher

(10) Patent No.: US 7,071,433 B2
(45) Date of Patent: Jul. 4, 2006

(54) ILLUMINATED MEMBRANE SWITCH

(75) Inventor: David Matthew Holscher, Salisbury, MA (US)

(73) Assignee: Ark-Les Corporation, Stoughton, WI (US)

( * ) Notice: Subject to any disclaimer, the term of this patent is extended or adjusted under 35 U.S.C. 154(b) by 0 days.

(21) Appl. No.: 10/986,612

(22) Filed: Nov. 12, 2004

(65) Prior Publication Data

US 2005/0103611 A1 May 19, 2005

Related U.S. Application Data

(60) Provisional application No. 60/520,476, filed on Nov. 14, 2003.

(51) Int. Cl.
*H01H 9/00* (2006.01)

(52) U.S. Cl. ..... 200/310; 200/314

(58) Field of Classification Search ..... 200/310–314, 200/512–520, 5 A, 5 R, 341
See application file for complete search history.

(56) References Cited

U.S. PATENT DOCUMENTS

| | | | | |
|---|---|---|---|---|
| 4,449,024 | A * | 5/1984 | Stracener | 200/317 |
| 4,551,598 | A * | 11/1985 | Hamilton et al. | 200/314 |
| 4,807,090 | A * | 2/1989 | Mandellos et al. | 362/26 |
| 5,225,891 | A * | 7/1993 | Choumei | 356/601 |
| 5,607,048 | A * | 3/1997 | Kaizu et al. | 200/314 |
| 5,834,745 | A | 11/1998 | Aoki et al. | |
| 6,082,866 | A * | 7/2000 | Amedee | 362/34 |
| 6,288,386 | B1 * | 9/2001 | Bowen et al. | 250/214 VT |
| 6,318,872 | B1 * | 11/2001 | Kato et al. | 362/26 |
| 6,590,174 | B1 * | 7/2003 | Zysnarski et al. | 200/310 |
| 6,605,483 | B1 * | 8/2003 | Victor et al. | 438/22 |
| 6,737,596 | B1 * | 5/2004 | Hein | 200/310 |
| 6,860,612 | B1 * | 3/2005 | Chiang et al. | 362/29 |

* cited by examiner

*Primary Examiner*—Michael Friedhofer
*Assistant Examiner*—Lisa Klaus
(74) *Attorney, Agent, or Firm*—Boyle Fredrickson Newholm Stein & Gratz S.C.

(57) ABSTRACT

An illuminated membrane switch employs transparent conductive elements in the region of the button so as to provide passage of light from behind the membrane switch to the user without shadowing by opaque conductive elements.

15 Claims, 1 Drawing Sheet

ILLUMINATED MEMBRANE SWITCH

CROSS-REFERENCE TO RELATED APPLICATIONS

This application claims the benefit of U.S. Provisional Application 60/520,476 filed Nov. 14, 2003, hereby incorporated by reference.

STATEMENT REGARDING FEDERALLY SPONSORED RESEARCH OR DEVELOPMENT

BACKGROUND OF THE INVENTION

The present invention relates to membrane switches and in particular to a membrane switch providing for backlit, illuminated buttons.

Membrane switches provide electrical contacts closing when a front flexible membrane is compressed by a finger touch or the like against a rear surface, typically a second membrane. Each of the membranes has electrical contacts printed on their opposing faces at button locations that are brought into electrical conduction when the membrane is flexed, and held apart by the natural elasticity of the membrane and a spacer layer when the front membrane is released.

In some applications, it may be desirable to illuminate the membrane switch, for example, by backlighting the individual buttons. While the membranes themselves may be transparent, the metallic conductors used to create the contacts block light producing shadows on the button face.

The prior art has addressed the problem of shadowing in a number of ways. Most simply the conductive areas of the contacts are moved from alignment with the light conducting areas of the button. In this approach, the light conductive areas must be minimized so as to not unduly limit the available conducting surface of the contacts, and the graphics layer (which defines the light conducting areas of the button) and membrane switch must be designed in tandem, making the design process more expensive and cumbersome.

An alternative approach to eliminating the shadows caused by the membrane switch conductors employs a diffuser or light pipe interposed between the membrane switch and the front graphic layer. While this approach allows for some standardization of the membrane switch components, it increases the complexity of the membrane switch and may undesirably increase the thickness of the switch and change its mechanical properties.

A third approach to providing illuminated membrane switches fabricates an electroluminescent (EL) panel on top of the membrane switch to completely avoid the opaque conductors. This approach requires a relatively complex fabrication process and the use of an electroluminescent panel for the light source.

SUMMARY OF THE INVENTION

The present invention provides an illuminated membrane switch that works with a variety of light sources while eliminating the problems of conductor shadowing, membrane switch thickness buildup, and area limitations in the graphically illuminated design. In the invention, the membrane switch conductors are fabricated from transparent conductor materials such as are commonly used in touch screens and the like. The higher resistance of these materials is moderated by the use of standard metallic conductors outside of the illuminated region and/or by the use of high impedance detection circuitry. A simple and compact illuminated membrane switch is created that allows for greater design flexibility in the illuminated region including, for example, an unbroken illuminated ring surrounding an illuminated character or symbol.

Specifically then, the present invention provides an illuminated membrane switch having a light conducting flexible sheet with a first discrete contact pad at a button location on a rear surface. The first discrete contact pad is a transparent conductor. A light-conducting panel behind the light conducting flexible sheet has a second discrete contact pad at the button location. The second discrete contact pad is also a transparent conductor. At least two conductive traces on the sheet or panel join the first or second discrete contact pad to an input circuit detecting contact of the first and second discrete contact pad with flexure of the first light conducting flexible sheet. A lamp assembly provides light passing through the light-conducting panel and light conducting flexible sheet at the button location.

Thus it is an object of at least one embodiment of the invention to provide a simple backlit membrane switch.

The light-conducting panel may be a flexible sheet.

Thus it is another object of at least one embodiment of the invention to provide an illuminated membrane switch employing conventional multiple sheet technology.

A portion of the conductive traces may be transparent and/or a portion opaque.

Thus it is another object of at least one embodiment of the invention to provide large area illumination without shadowing of the graphic symbols and yet to permit the use of metallic traces or carbon traces to lower the resistance of the thus produced membrane switch.

The membrane switch may include a printed graphic at the front surface of the first conductive sheet selectively blocking light to provide button indicia at the button location.

Thus it is another object of at least one embodiment of the invention to permit complex illuminated symbols to be easily and flexibly created.

The graphic may be on the rear surface of a second light transmitting flexible sheet placed on the front surface of the first light conducting flexible sheet.

Thus it is another object of at least one embodiment of the invention to provide a separation between the graphics and the membrane switch for simplified manufacture and reuse of components.

The printed graphic may include a ring providing an unbroken light-transmitting path around the button location.

Thus it is another object of at least one embodiment of the invention to permit a striking, intuitive illuminated target around the button.

The transparent conductor may be indium tin oxide, for example, etched into the necessary pattern for the contact.

It is thus another object of at least one embodiment of the invention to provide a method of using standard indium tin oxide coated flexible sheets.

The lamp assembly may be a light diffuser and a lamp or a light pipe and a lamp.

Thus it is another object of at least one embodiment of the invention to provide a displacement of the diffusing behind the membrane switch so as not to interfere with its action.

The lamp may be an LED, an incandescent bulb, a fluorescent lamp, or an EL panel.

It is another object of at least one embodiment of the invention to allow flexible selection of the light source.

The transparent conductor may be a transparent ink.

It is thus another object of at least one embodiment of the invention to provide a method of fabricating the present switch using standard printing techniques.

The input circuit may be a high impedance amplifier measuring changes in resistance potentially greater than 100 ohms.

It is thus another object of at least one embodiment of the invention to accommodate the higher resistance inherent in transparent conductors.

These particular objects and advantages may apply to only some embodiments falling within the claims and thus do not define the scope of the invention.

DETAILED DESCRIPTION OF THE PREFERRED EMBODIMENT

Figure 1:
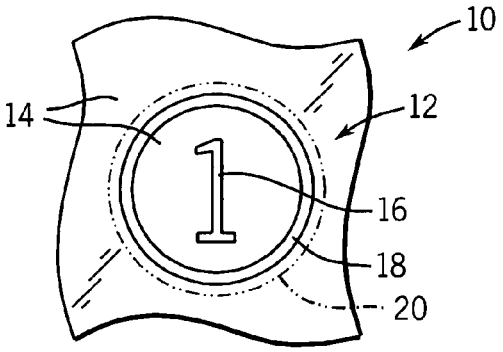
FIG. 1 is a figure showing an example graphic that may be illuminated with the present invention having an unbroken illuminated ring surrounding an illuminated symbol.

Referring now to FIG. 1, an illuminated membrane switch 10 of the present invention may provide for a graphic 12 to define a button area 20 and having printed opaque areas 14 selectively blocking the transmission of light to define an illuminated symbol 16 surrounded by an unbroken, illuminated ring 18. The graphic 12 thus defines a target to be pressed by a user to activate a particular membrane switch.

Figure 2:
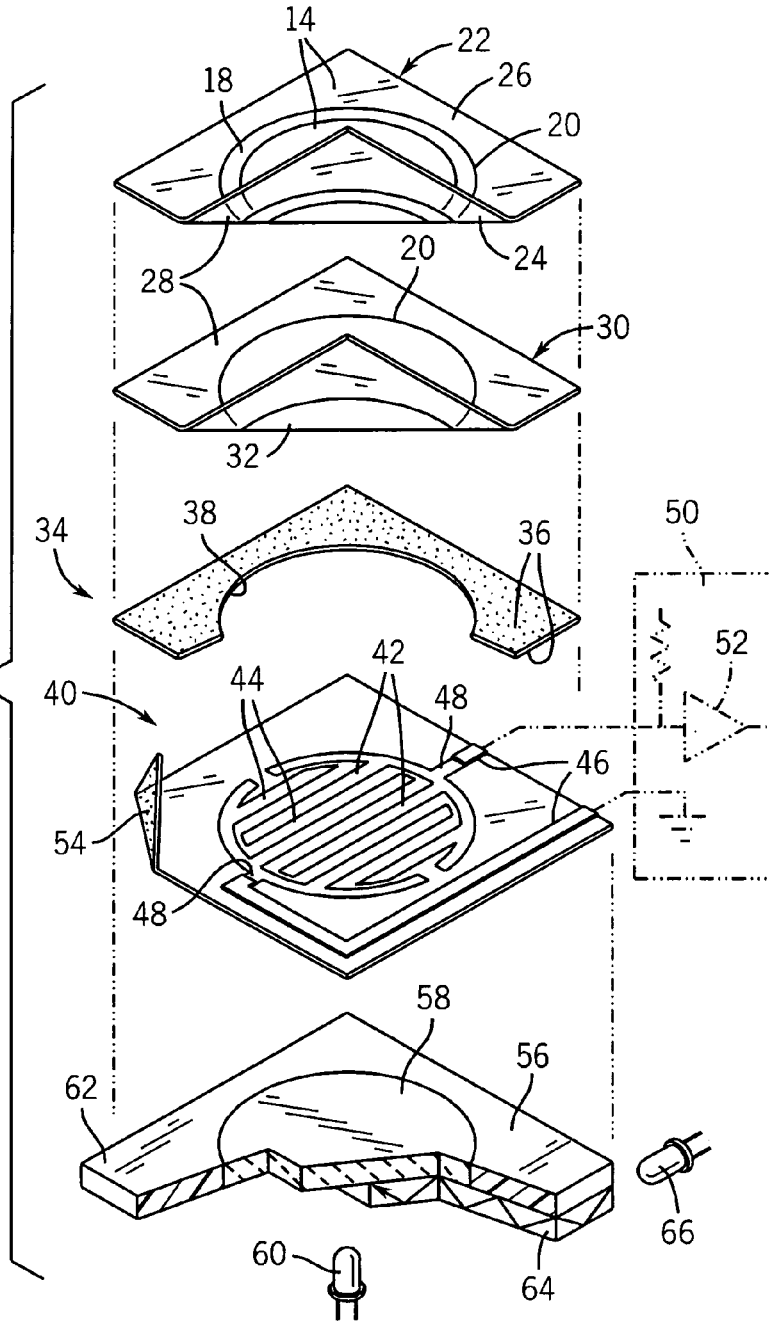
FIG. 2 is a perspective, exploded, fragmentary view of the switch of the present invention showing direct and light diffuser illumination.

Referring also to FIG. 2, starting at an outer face toward the user, the illuminated membrane switch 10 includes a graphic layer 22 being a flexible, transparent polyester, polycarbonate, or other transparent sheet material well known in the art. The graphic layer 22 is printed on its rear, inner surface an opaque ink 24 such as creates the printed opaque areas 14. By printing on the rear side of the sheet of the graphic layer 22, the ink is protected from abrasion. Optionally, a textured ink 26 may be printed on the upper surface of the graphic layer 22 or it may be embossed in another manner.

A transparent adhesive 28 is printed or otherwise applied over the ink 24 on the rear surface of the graphic layer 22 or on the front, outer surface of the outer switch circuit layer 30 attached to the rear surface of the graphic layer 22 to attach the graphic layer 22 to the outer switch circuit layer 30.

The outer switch circuit layer 30 is also a transparent flexible sheet, for example, a clear polyester material. The outer switch circuit layer 30 has a conductive shorting pad 32 printed on its rear surface to form a first discrete contact pad, typically with an area commensurate with the button area 20.

The conductive shorting pad 32 is a transparent conductor such as indium tin oxide (ITO) and may be formed by etching away a continuous film of ITO applied to the material of the outer switch circuit layer 30 by well understood techniques or may be printed using a transparent conductive ink of a type well known in the art. Positioned behind the outer switch circuit layer 30 is a spacer layer 34 having adhesive 36 printed or otherwise applied on its outer and inner side and having an opening 38 aligning with the button area 20. Spacer layer 34 joins the outer switch circuit layer 30 with inner switch circuit layer 40.

The inner switch circuit layer 40 has, on its outer surface a contact pad formed of interdigitated transparent conductive fingers 42 and 44 fitting within the button area 20. These conductive fingers 44 and 42 are formed of a transparent conductive material such as indium tin oxide appropriately etched or a printed transparent ink as described above.

The conductive fingers 44 and 42 join with conventional printed silver conductive traces 46 by means of optional transparent conductive traces 48, the latter serving to move the opaque shadows of the silver conductive traces 46 away from the button area 20 to eliminate the possibility of shadowing.

Conductive traces 46 join with a detector circuit 50 having in one embodiment high impedance detector amplifier 52 for each button or multiplexed among buttons for detecting change in resistance across the conductive traces 46 caused by a shorting of the fingers 44 and 42 by the shorting pad 32 pressed inward through opening 38 in the spacer layer 34. Whereas a conventional membrane switch having a carbon or other opaque conductive shorting pad 32, and opaque metallic silver or other opaque conductive fingers 42 and 44 may provide for a contact resistance as low as 100 ohms, the present amplifier 52 provides for detection of a contact resistance as high as 1,000 ohms or more such as may be produced by the transparent conductive elements and their higher contact resistance.

Alternatively, the transparent conductive traces 48 may be extended all the way to the amplifier 52 to eliminate the need for a second manufacturing step for short runs in which the excess resistance may be tolerated.

Inner switch circuit layer 40 may also be constructed from a flexible transparent sheet, for example, a polyester material. Alternatively a stiff material may be used, for example, the lens case assembly 56 described below.

When the inner switch circuit layer 40 is constructed from a flexible transparent sheet, the rear side of inner switch circuit layer 40 is coated with a transparent adhesive 54 to attach it to a lens case assembly 56 on a rear surface of inner switch circuit layer 40. The lens case assembly provides for a source of light through the button area 20 such as may be provided by a diffuser element 58 sized to be approximately equal to the button area 20, surrounded by an opaque mask element 62 if necessary, to concentrate the illumination at the button area 20. The diffuser element 58 may be a translucent plastic material illuminated by a lamp 60 or the like, including for example, an LED, an incandescent bulb, a fluorescent lamp, or an EL panel. Alternatively to direct illumination by lamp 60, a light pipe 64 may be used, illuminated by remote LEDs 66 or other light sources according to techniques well known in the art.

It will be understood that the particular transparent conductive materials used may be selected by those of ordinary skill in the art to include materials other than indium tin oxide and transparent printing inks. Further, additional mask locations or alternative locations of the graphics may be made without fundamentally affecting the design. As will be well understood to those of ordinary skill in the art, location of the shorting pads and interdigitated fingers 44 and 42 may be switched with a shorting pad below the fingers 44 and 42 with respect to the pressing by the user.

It is specifically intended that the present invention not be limited to the embodiments and illustrations contained herein, but include modified forms of those embodiments including portions of the embodiments and combinations of elements of different embodiments as come within the scope of the following claims.

I claim:

1. An illuminated membrane switch comprising:

a light conducting flexible sheet having on a rear surface a first discrete contact pad at a button location, the first discrete contact pad being a transparent conductor;

a light conducting panel having on a front surface, facing the rear surface of the light conducting flexible sheet, a second discrete contact pad at the button location, the second discrete contact pad being a transparent conductor;

at least two conductive traces on at least one of the light conducting flexible sheet and light conducting panel connecting at least one of the first discrete contact pad and second discrete contact pad to an input circuit detecting contact of the first discrete contact pad and second discrete contact pad with flexure of the light conducting flexible sheet; and a lamp assembly providing light at the button location the light passing through the light conducting panel and light conducting flexible sheet at the button location.

2. The illuminated membrane switch of claim 1 wherein the light conducting panel is a flexible sheet.

3. The illuminated membrane switch of claim 1 wherein at least a portion of the conductive traces are transparent.

4. The illuminated membrane switch of claim 1 wherein at least a portion of the conductive traces are opaque.

5. The illuminated membrane switch of claim 1 further including a printed graphic arranged over a front surface of the light conducting flexible sheet to selectively block light and provide a button indicia at the button location.

6. The illuminated membrane switch of claim 5 wherein the printed graphic includes a ring providing an unbroken light-transmitting path around the button location.

7. The illuminated membrane switch of claim 5 wherein the printed graphic is on the rear surface of another light transmitting flexible sheet placed over the front surface of the light conducting flexible sheet.

8. The illuminated membrane switch of claim 1 wherein the lamp assembly is a light diffuser and lamp.

9. The illuminated membrane switch of claim 1 wherein the lamp assembly is a light pipe and lamp.

10. The illuminated membrane switch of claim 1 wherein the lamp assembly uses a lamp selected from the group consisting of at least one: LED, incandescent bulb, fluorescent lamp, or EL panel.

11. The illuminated membrane switch of claim 1 wherein the transparent conductor is indium tin oxide.

12. The illuminated membrane switch of claim 1 wherein the transparent conductor is a transparent ink.

13. The illuminated membrane switch of claim 1 wherein the light conducting flexible sheet is a polyester.

14. The illuminated membrane switch of claim 1 wherein the input circuit is a high input impedance amplifier measuring changes in resistances greater than 100 ohms.

15. A method of manufacturing an illuminated membrane switch comprising:

(a) etching a first discrete contact pad at a button location from a light conducting flexible sheet having an indium tin oxide film on a rear surface;

(b) etching a second discrete contact pad at the button location from a second light conducting flexible sheet having an indium tin oxide film on a front surface;

(c) printing at least two conductive traces from an opaque conductor on at least one of the first and second light conducting flexible sheets to join at least one of the first discrete contact pad and second discrete contact pad to an input circuit;

(d) placing the first and second flexible sheets in opposition about a spacer to fabricate a transparent membrane switch; and (e) affixing the first and second sheets to a lamp assembly providing light at the button locations passing through the light conducting panel and light conducting flexible sheet at the button location.

* * * * *